US006551121B1

(12) United States Patent
Li et al.

(10) Patent No.: US 6,551,121 B1
(45) Date of Patent: Apr. 22, 2003

(54) CARD EDGE CONNECTOR HAVING COMPACT STRUCTURE

(75) Inventors: Chun Sheng Li, Kunsan (CN); Guang Xing Shi, Kunsan (CN); Heseng Fang, Kunsan (CN); Weiya Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,676

(22) Filed: Dec. 27, 2001

(51) Int. Cl.[7] ..... H01R 13/62
(52) U.S. Cl. ..... 439/328; 439/376
(58) Field of Search ..... 439/327, 326, 439/328, 325, 630, 631, 632, 633, 634, 635, 636, 637, 260

(56) References Cited

U.S. PATENT DOCUMENTS 5,199,895 A * 4/1993 Chang ..... 439/326
5,755,585 A * 5/1998 Cheng et al. ..... 439/326
6,024,592 A * 2/2000 Pai et al. ..... 439/326

* cited by examiner

*Primary Examiner*—P. Austin Bradley
*Assistant Examiner*—Alexander Gilman
(74) *Attorney, Agent, or Firm*—Wei Te Chung

(57) ABSTRACT

A card edge connector (1) comprises an insulative housing (10) having opposite top and bottom walls (12, 14) defining a central slot (142) therebetween for receiving the electronic card, a row of upper contacts (15) and a row of lower contacts (16) retained in the top and bottom walls, respectively. A supporting embossment (1461) is formed in each of the lower passageways. Each of the upper and lower contacts forms a retaining portion (150, 160), a mating beam (152, 162) and a soldering portion (154, 164) extending from opposite ends of the retaining portion, respectively. The mating beam of the lower contact is shorter than the mating beam of the upper contact and is apart from and above the supporting means with a distance which is within the spring limitation amount of the mating beam of a corresponding lower contact retained in the housing.

5 Claims, 5 Drawing Sheets

CARD EDGE CONNECTOR HAVING COMPACT STRUCTURE

BACKGROUND OF THE INVENTION

1. Field of the Invention

The present invention relates to an electrical connector, and particularly to a card edge connector used for a notebook computer.

2. Description of Prior Art

Card edge connectors are widely used in notebook computers for electrically connecting an electronic card to a printed circuit board (PCB). Such card edge connectors are disclosed in U.S. Pat. Nos. 6,042,411 and 5,997,332. Referring to FIG. 6, a prior art card edge connector 1' comprises an elongate housing 10' having opposite top and bottom walls 14', 16', two rows of conductive contacts (not shown) respectively retained in walls 14' and 16'. The top and bottom walls 14', 16' define a receiving slot 142' therebetween for receiving an electronic card (not shown), and the top wall 14' is narrower than the bottom 16' for easy insertion of the electronic card by way of being slantedly inserted into the receiving slot 12'. However, with the miniaturization trend of notebook computers, it is desired that the width of the bottom wall 16' which is mounted on the PCB could be as narrow as possible for reducing its layout space on the PCB. In other words, if the bottom wall 16' becomes narrower, the conductive contacts retained therein must be shorter accordingly, which will adversely affect their performance, such as their resilience and so on. Thus, how to maintain good performance of the shortened conductive contacts is an important issue.

Hence, it is desired to provide an improved card edge connector which can occupy a comparative small space in the notebook computer while maintaining good performance for the conductive contacts thereof.

BRIEF SUMMARY OF THE INVENTION

A main object of the present invention is to provide a card edge connector which can occupy comparatively small space in a notebook computer while maintaining good performance for the conductive contacts thereof.

To fulfill the above mentioned object, a card edge connector in accordance with the present invention is adapted for electrically connecting an electronic card to a circuit board. The card edge connector comprises an insulative housing having opposite top and bottom walls defining a central slot therebetween for receiving the electronic card therein, a row of upper contacts and a row of lower contacts being retained in the top and bottom walls, respectively. A supporting means, shaped in an embossment, is formed in each of the lower passageways. Each of the upper and lower contacts forms a retaining portion, a mating beam and a soldering portion extending from opposite ends of the retaining portion, respectively. The mating beam of the lower contact is shorter than the mating beam of the upper contact and is a partly above the supporting means with a distance which is with the spring limitation amount of the mating beam of a corresponding lower contact retained in the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
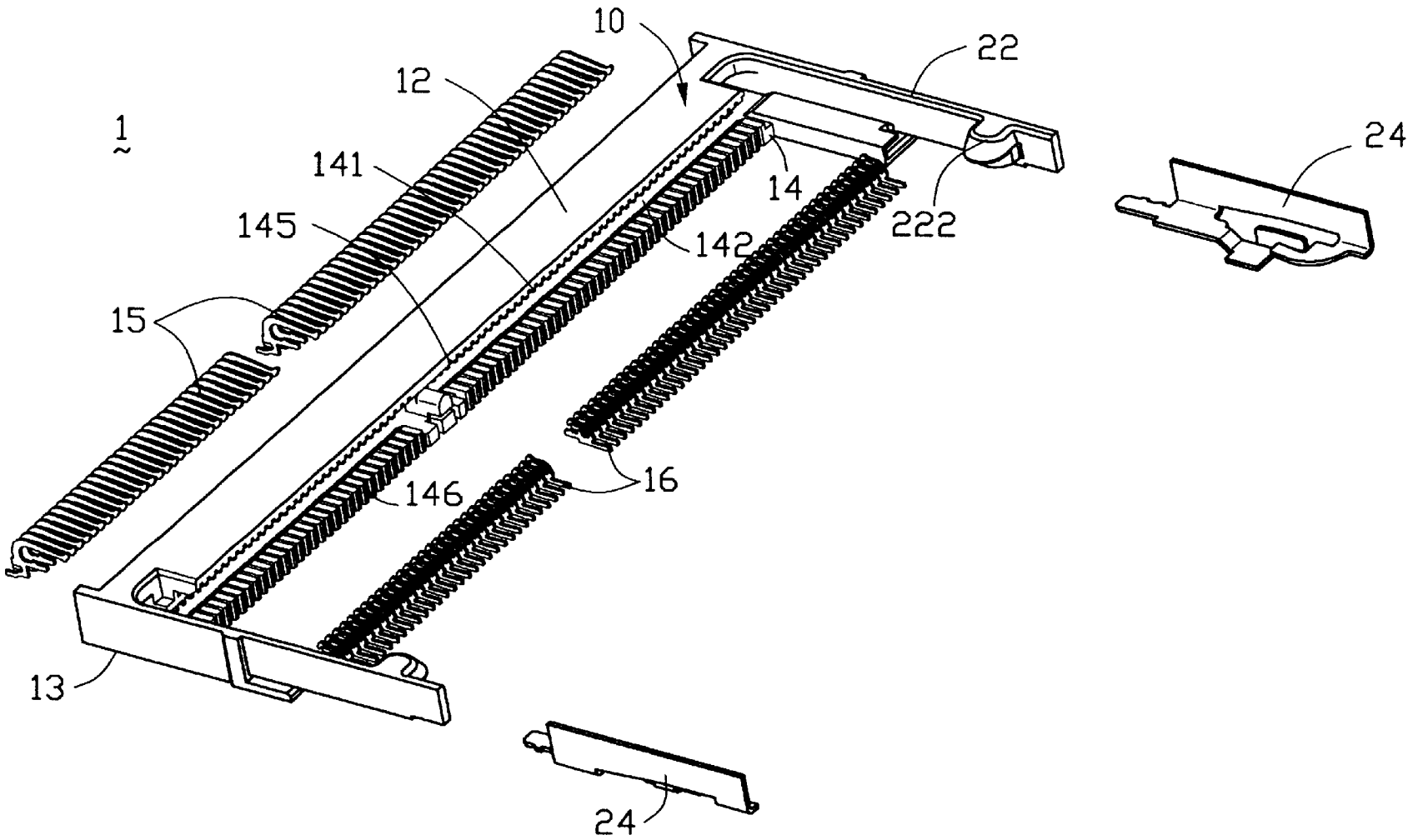
FIG. 1 is an exploded perspective view of a card edge connector in accordance with the present invention.
Figure 2:
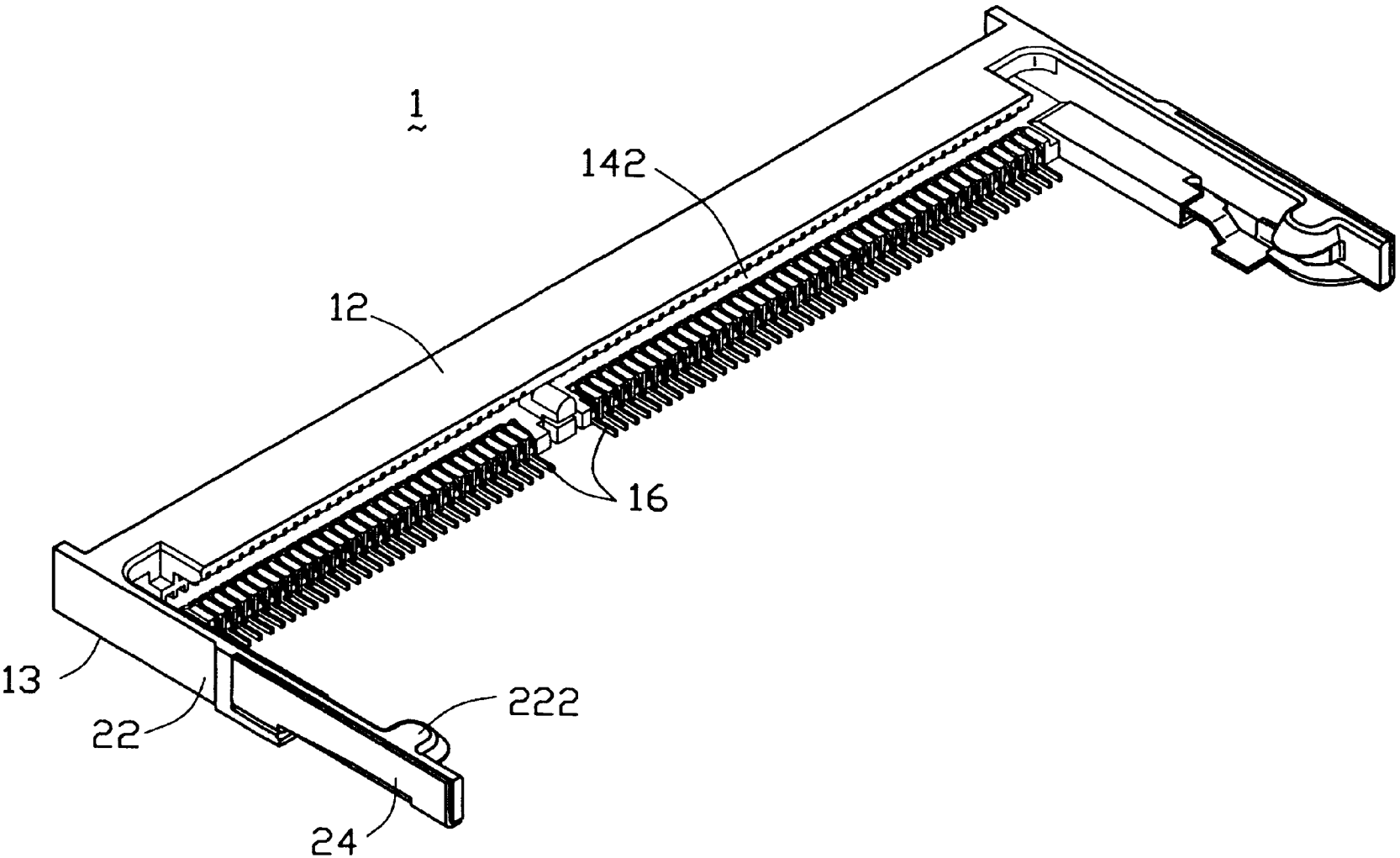
FIG. 2 is an assembled view of FIG. 1.
Figure 3:
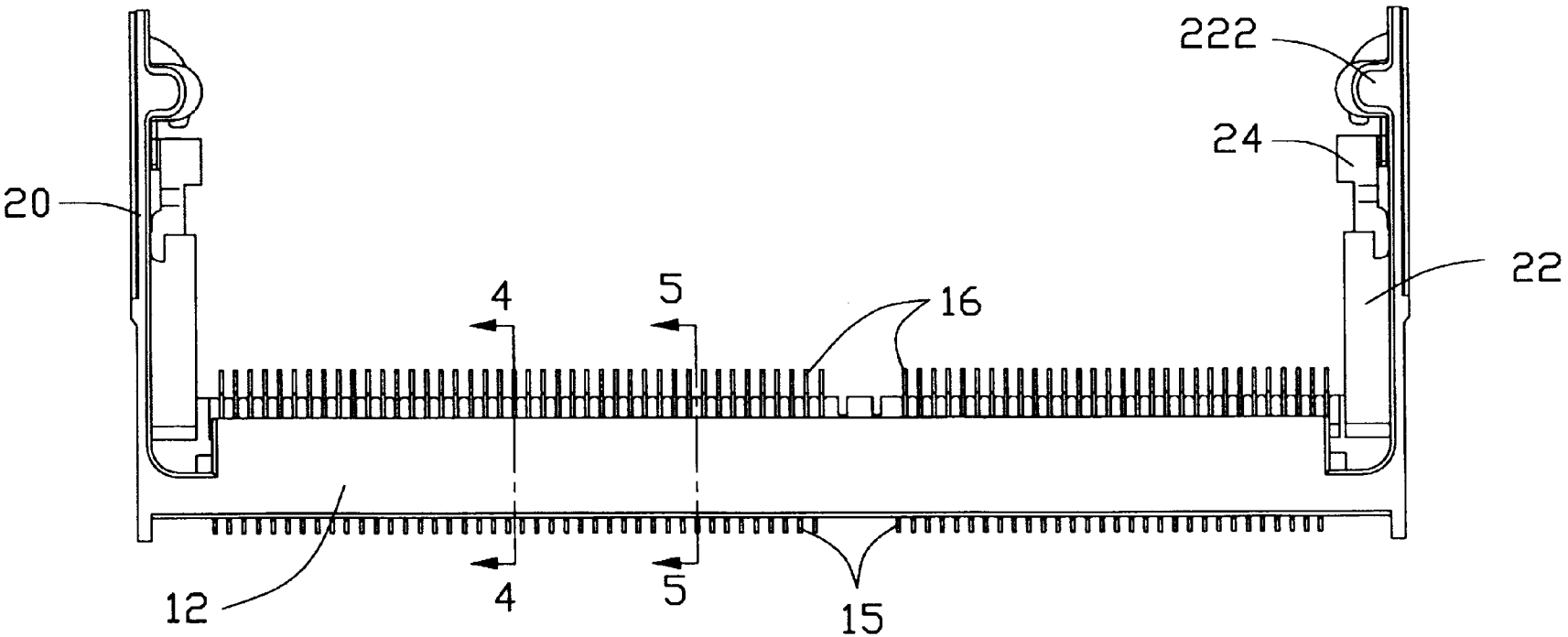
FIG. 3 is a top view of FIG. 2.

Below the preferred embodiment of the present invention is detailed explained to the drawing figures.

Referring to FIG. 1 first, a card edge connector 1 in accordance with the present invention comprises an elongate housing 10, a row of upper contacts 15 and a row of lower contacts 16 respectively retained in the housing 10, and a pair of metal latches 24 attached to opposite ends of the housing 10.

The elongate housing 10 has opposite top and bottom walls 12, 14 defining a central slot 142 therebetween for receiving an electronic card (not shown) therebetween. The top and bottom walls 12, 14 respectively define a row of upper passageways 145 and a row of lower passageways 146 which are communicated with the central slot 142. The bottom wall 16 has a bottom face 13 to be mounted on an underlying PCB (not shown) and is slightly wider than the top wall 14 for easily insertion of the electronic card. Additionally, a pair of latching members 22 are integrally formed at opposite ends of the elongate housing 10, and each forms a latching portion 222 for latching/ejecting the electronic card with/from the housing 10. The pair of metal latches 24 are respectively fastened to the latching members 22 for strengthening the intensity of the latching members 24. Furthermore, referring to FIG. 4, a supporting member 1461, shaped in an embossment, is formed in each lower passageway 146 of the housing 10 for supporting a corresponding lower contact 146, as will be illustrated below.

Figure 5:
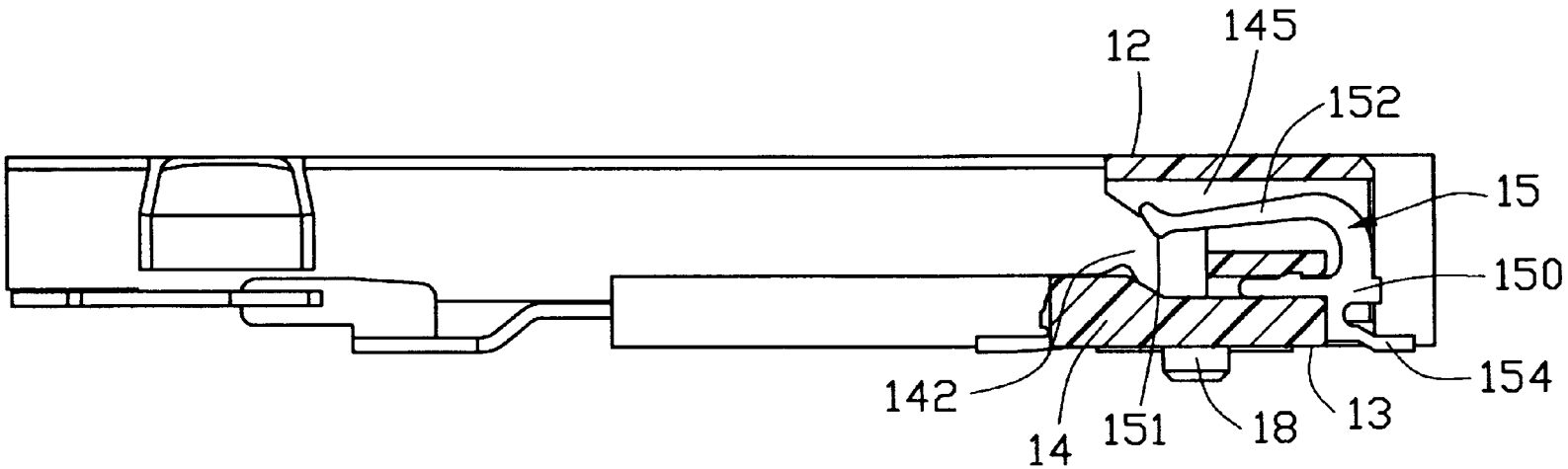
FIG. 5 is a cross-sectional view taken along line 5—5 of FIG. 3.
Figure 6:
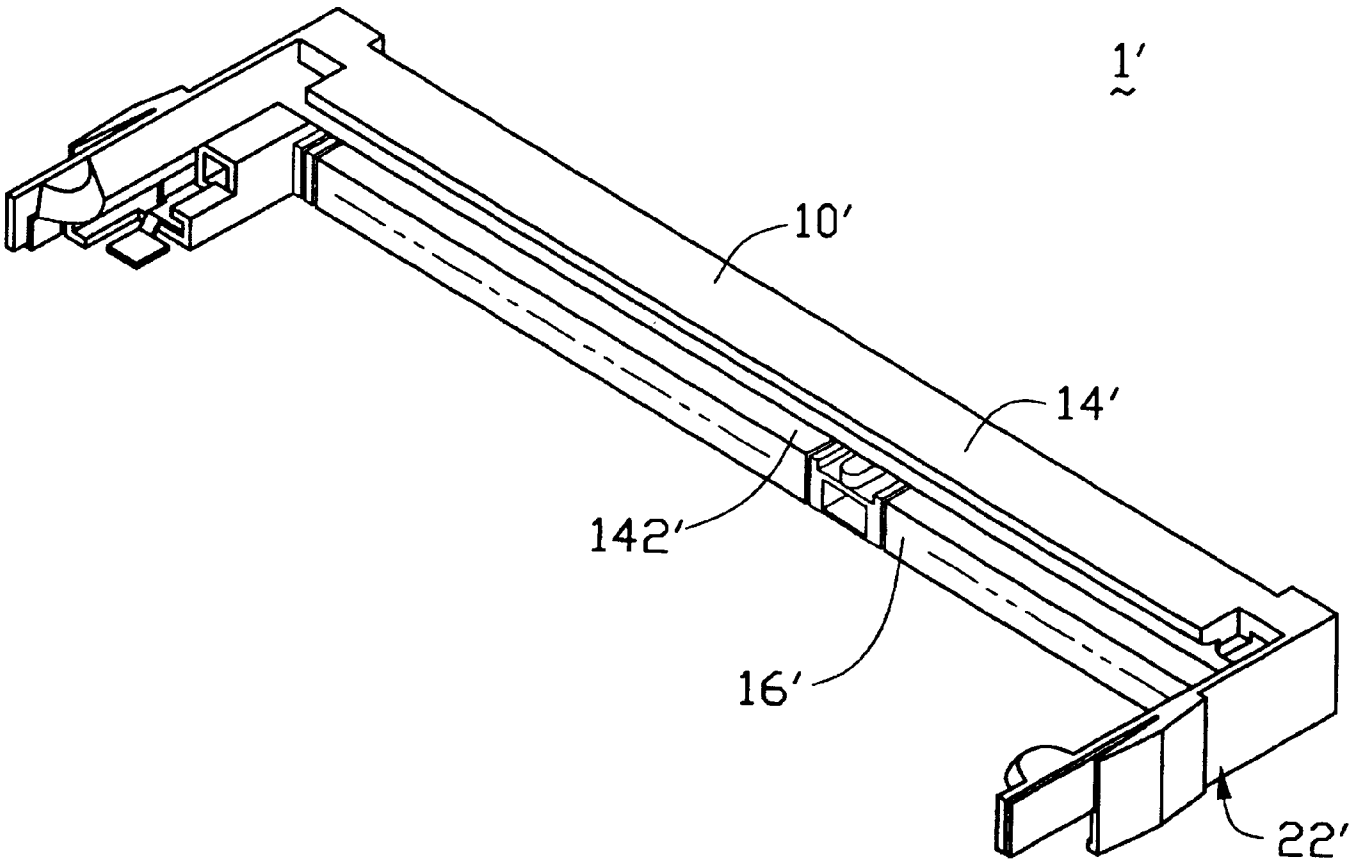
FIG. 6 (PRIOR ART)
FIG. 6 is a perspective view of a prior art cad edge connector.

Further referring to FIG. 5, the row of upper contacts 15 are inserted into corresponding upper passageways 145 of the housing 10 and are adapted for conductively contacting with corresponding gold fingers formed on one side face of the electronic card. The upper contact 15 has a retaining portion 150 retained in a corresponding upper passageway 145, a mating beam 152 and a horizontal soldering portion 154 extending from opposite ends of the mating beam 150, respectively. The mating beam 152 forms a contact portion 151 at a tip end thereof and extending into the central slot 142 for conductively contacting a corresponding gold finger of the electronic card.

Figure 4:
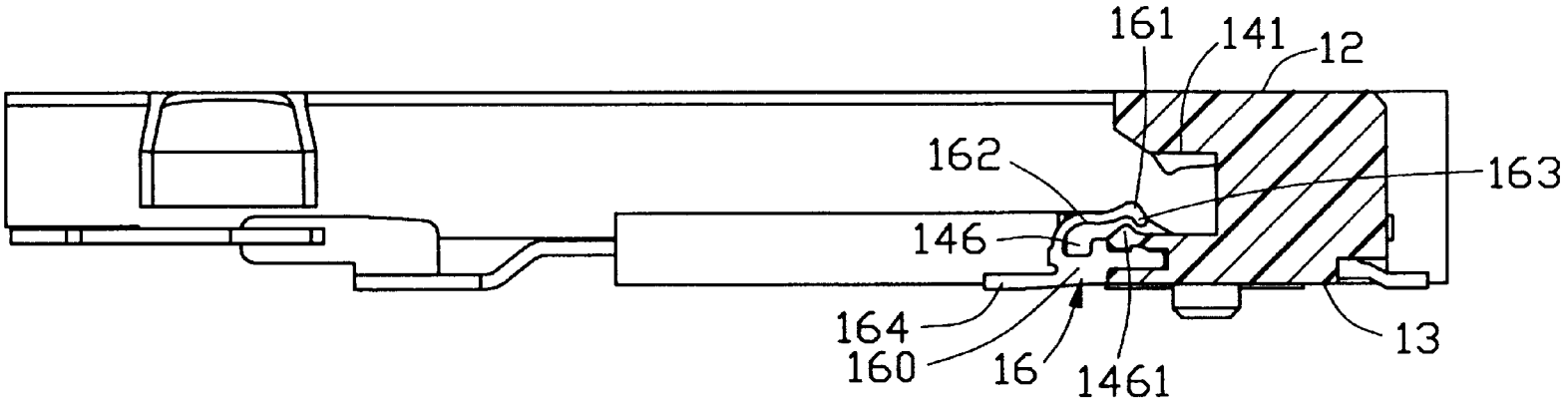
FIG. 4 is a cross-sectional view taken along line 4—4 of FIG. 3.

Referring to FIG. 4, the lower contacts 16 are inserted into corresponding lower passageways 146 of the housing 10 and each forms a retaining body 160 retained in the lower passageways 146, a mating beam 162 and a soldering portion 164 extending from opposite ends of the retaining body 160. The mating beam 162 is much shorter than the mating beam 152 of the upper contact 15 and can provides enough normal force for securing a reliable connection with the inserted electronic card. The mating beam 162 forms a contact portion 161 extending into the central slot 142 at a tip end thereof for conductively contacting a corresponding gold finger formed on the other side surface of the electronic card. Meanwhile, the contact portion 161 of the mating beam 162 is located above and distanced from the supporting member 1461 with a predetermined distance which is within a spring limitation amount of the mating beam 162 of the lower contact 16. Thus, the supporting member 1461 can support the contact portion 161 during the contact portion 161 springly bending downward to mate with the inserted electronic card, thereby preventing the mating beam 162 from spring yield. Using this arrangement, the card edge connector 1 of the present invention can occupy a comparative small space in the notebook computer while maintain good performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for electrically connecting an electronic card to a circuit board, comprising:

an insulative housing having opposite top and bottom walls defining a central slot therebetween for receiving an electronic card therein, a row of upper passageways and a row of lower passageways defined in the top and bottom walls, respectively, and both communicated with the central slot, and a supporting means formed in each of the lower passageways;

a row of upper contacts and a row of lower contacts being inserted into corresponding upper and lower passageways of the insulative housing, respectively, each of the upper and the lower contacts forming a retaining portion retained in a corresponding one of the upper and the lower passageways, a mating beam and a soldering portion extending from the retaining portion, respectively, the mating beam of the lower contact being shorter than the mating beam of the upper contact and being distanced from and above the supporting means with a distance within a spring limitation amount of the mating beam of the lower contact; and a pair of latching members integrally formed on opposite ends of the insulative housing for latching the electronic card with the housing, wherein the supporting means of the insulative housing is an embossment and the mating beam of the lower contact forms a contact portion vertically above and distanced from the embossmen, said embossment is configured to engage a respective recess in the mating beam when a card inserted in the slot.

2. The card edge connector as claimed in claim 1, wherein the bottom wall of the insulative housing is to be horizontally mounted on the circuit board, and is slightly wider than the top wall of the insulative housing.

3. The card edge connector as claimed in claim 1, wherein the soldering portions of the upper and lower contacts are to be horizontally soldered to the circuit board.

4. The card edge connector as claimed in claim 1, wherein each latching member forms a latching portion for latching with the electronic card.

5. The card edge connector as claimed in claim 4, wherein a metal latch is fastened to each latching member.

* * * * *